United States Patent [19]

Kuchimanchi et al.

[11] Patent Number: 4,872,682

[45] Date of Patent: Oct. 10, 1989

[54] CUBE PUZZLE WITH MOVING FACES

[76] Inventors: Ravi Kuchimanchi, Dept. of Physics, Univ. of Maryland, College Park, Md. 20742; Madhukar N. Thakur, Board of Studies in Computer and Information Sciences, Univ. of California, Santa Cruz, Calif. 95064

[21] Appl. No.: 108,163

[22] Filed: Nov. 17, 1987

[51] Int. Cl.[4] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 3,655,201 | 4/1972 | Nichols | 273/153 S |
| 4,373,729 | 2/1983 | Hanson et al. | 273/153 S |
| 4,405,131 | 12/1983 | Horvath | 273/153 S |
| 4,407,502 | 10/1983 | Paulos | 273/153 S |
| 4,412,681 | 11/1983 | Irwin | 273/153 S |
| 4,418,914 | 12/1983 | Bauer | 273/153 S |
| 4,418,915 | 12/1983 | Calebs | 273/159 |
| 4,421,311 | 12/1983 | Schesteny | 273/153 S |

FOREIGN PATENT DOCUMENTS

| | | | |
|---|---|---|---|
| 42772 | 12/1981 | European Pat. Off. | 273/153 S |
| 54886 | 6/1982 | European Pat. Off. | 273/153 S |
| G8126065.2 | 6/1982 | Fed. Rep. of Germany | 273/153 S |
| 2515525 | 5/1983 | France | 273/153 S |
| 1183136 | 10/1985 | U.S.S.R. | 273/153 S |
| 1181674 | 9/1986 | U.S.S.R. | 273/153 S |
| 2084471 | 4/1982 | United Kingdom | 273/153 S |

*Primary Examiner*—Anton O. Oechsle

*Attorney, Agent, or Firm*—Wm. D. Johnston, III

[57] ABSTRACT

A puzzle cube with movable sliders provides games with different levels of difficulty. At least one of the surfaces of the cubelets forming an exterior surface part of the base cube is not provided with a slider, thus defining at least one blank. This allows during the game the moving of anyone of the sliders adjacent a blank, on the same side of the base cube, to be moved into the blank. Each slider can be numbered, or given an orientation such as by an arrow thereon, or all the sliders for each side of the base cube can be given a respective different color, either by being so manufactured or by means of stickers placeable on the sliders. The respective parts of the base club can also be colored and/or numbered, for instance the bands along the intersections of the exterior surfaces (faces) of the base cube, these bands extending peripherally as a frame around the collection of sliders on each face of the base cube. The engagement of the sliders with the cubelets can be designed to prevent a slider from being able to slide out of a channel, that is, for holding it on the cubelet, during rotation of one of the planes of cubelets of the base cube.

20 Claims, 14 Drawing Sheets

CUBE PUZZLE WITH MOVING FACES

BACKGROUND OF THE INVENTION

The invention involves a cube-shaped puzzle, having movable faces. More particularly, the invention relates to a cube puzzle for amusing people of all ages.

Puzzles in the shape of cubes are well-known. The hitherto known cubes are basically restricted to the triaxial rotation of the cube, but there are no puzzles at present having two surfaces, one within the other, which move relative to each other.

SUMMARY OF THE INVENTION

An object of the invention is to provide a puzzle with a mechanism in which one can not only rotate the faces of the cube, but also have parts in the same mechanism which one can slide from one region to another on the faces of the cube. The sliding parts can thus be moved to different faces of the cube. Such a mechanism with features of both rotation and sliding is entirely new and is not present in any known cube.

Another object is to use this new mechanism to generate a variety of new and interesting games by providing a combination of colors and/or arrows, numbers, other patterns, etc. to both the parts which slide and the parts which only rotate. Thus, the player would have to not only figure out a method to bring all the colors together on the faces, but would have to simultaneously match the colors, numbers and arrows of the sliding parts with those on the rotating parts. This idea of matching sliding parts with rotating parts is an entirely new idea, and is not present in any existing cubes.

Another object is to have a variety of games of different complexity levels on the same puzzle by varying the combinations of colors and/or arrows, numbers, other patterns, etc. provided to the sliding and rotation parts by means of stickers.

Another object is to provide channels on the faces of existing cubes, and sliders which can slide in these channels. Such channels and sliders according to the present invention are not present in any known cube puzzles. Thus the improved cube puzzle not only has faces which can be rotated, but also sliders which can be slid in channels constructed on these faces.

Thus the modified cube puzzle is made according to the present invention of parts including sliders, cubelets containing channels, a triaxis, spiral springs, washers and bolts, etc. These parts are assembled together so that the cubelets get interlocked and the sliders have a free movement along the channel network. This forms a puzzle in the form of a cube.

Accordingly, the present invention provides an improved puzzle cube with a spindle including a triaxis, a plurality of sliders, and a plurality of cubelets, each of the cubelets being provided with T-slots (as described in the preferred embodiment, or appropriate V-shaped or other slots may be provided) which form a channel network, for sliding therein the sliders, when the cubelets are assembled on the triaxis arrangement. The sliders provide, except for at least one, the faces of the cubelets which are seen by a user, and are rotatable with the cubelets and slidable from one region to another region on the faces of the cube.

Each part of this toy may be manufactured of wood, plastic or a like rigid material. For playing, groups of the cubelets and sliders are colored differently. Each of the sliders and cubelets may also have numerical indications and/or arrows to make the puzzle more complex.

The invention will now be described with reference to the drawings, as an exemplary embodiment only.

DESCRIPTION OF PREFERRED EMBODIMENTS

Figure 1:
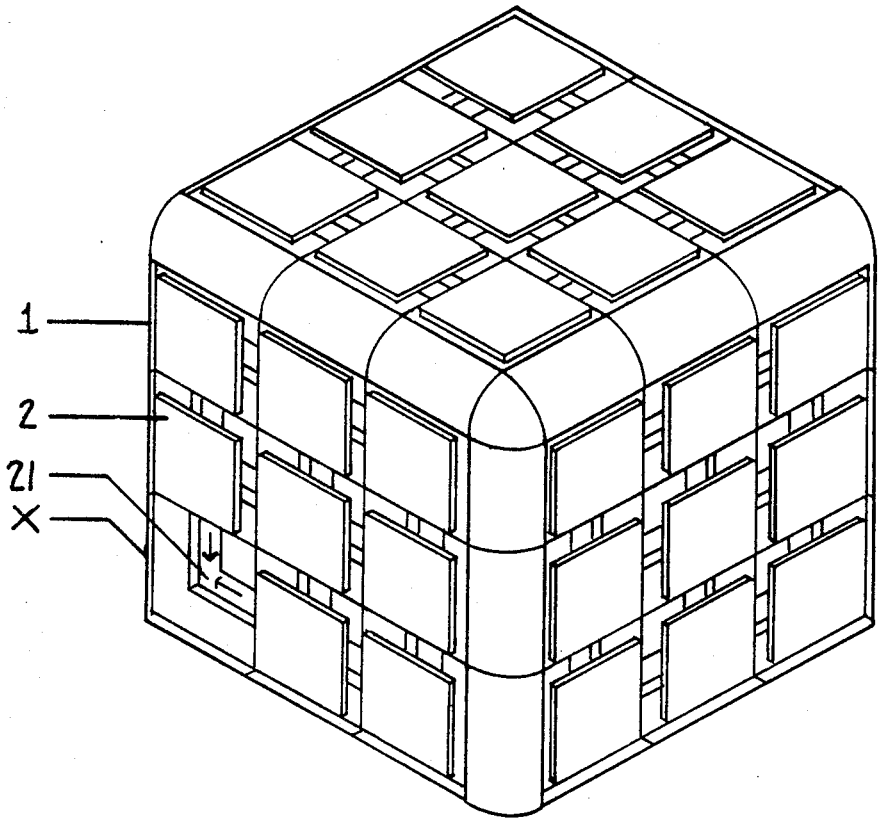
FIG. 1 shows an isometric view of the complete assembled puzzle, without stickers on the slider faces.

FIG. 1 shows the complete cube-shaped puzzle in an assembled position according to the present invention. The cube puzzle is assembled from sliders and the base cube.

Figure 2A:
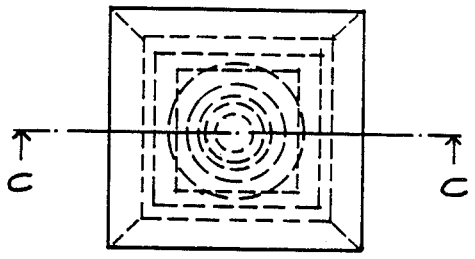
FIGS. 2A, 2B and 2C show plan, sectional elevational and isometric views of the slider 2, respectively with FIG. 2C having a" different size scale.
Figure 2B:
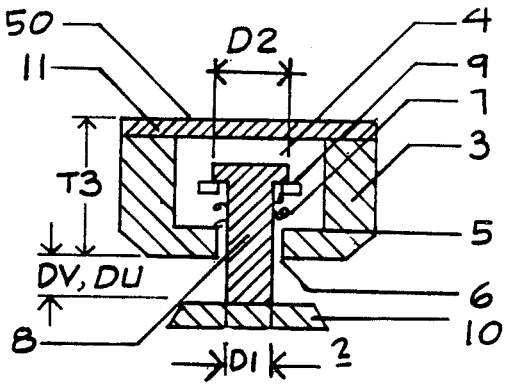
Figure 2C:
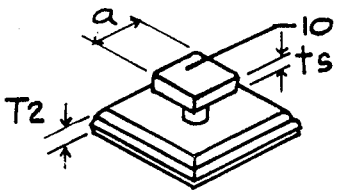

The slider 2 illustrated in FIGS. 2A to 2C consists of a parallelepiped box 3 with chamfers on the bottom edges and being open on top, in which a central hole 4 narrows at the interface 5 to a smaller hole 6. A spring 7 of external diameter greater than that of hole 6 but less than that of hole 4 is inserted into the hole 4 of the parallelepiped box 3 so that it rests on the interface 5. The connecting rod 8 of smaller diameter D1 (FIG. 2B) slightly less than that of hole 6 is bolt-like and is inserted through a washer 9 and through holes 4 and 6 as indicated also by dotted lines in FIG. 2A. The washer 9 has an internal diameter that is smaller than the external diameter of the spring 7, and an external diameter that is slightly less than that of hole 4 and the spring 7. The greater diameter D2 (FIG. 2B) of the connecting rod 8 is less than the diameter of hole 4 and internal diameter of the spring 7, but is greater than the internal diameter of the washer 9. A small chamfered square plate 10 (of thickness ts as in FIG. 2C) is attached to the connecting rod 8 by screws or any other method, such that the square plate 10 and the parallelopiped box 3 are parallel to each other. The connecting rod is thus attached to the square plate 10 at its center. This distance DV between part 3 and part 10 (FIG. 2B) is provided as a variable distance which varies with the compression of the spring 7. The minimum value of this variable distance DV is DU when the spring 7 is most unstretched or uncompressed.

As shown in FIG. 2B, the top opening of the parallelepiped box 3 is covered by a square plate of cap 11. The exposed face of the cap 11 is defined as the fascicle 50 (FIG. 2B) of the slider 2.

While such a preferred slider has been described, other sliders such as with two plates parallel to each other and rigidly connected by a rod of appropriate dimensions are possible. Also, for example, some sliders may have circular or other geometrical shape for respective parts. Yet other embodiments might have V-shaped or other appropriate slots for their channels, and apropriately shaped sliders to fit and slide in such channels.

Figure 3A:
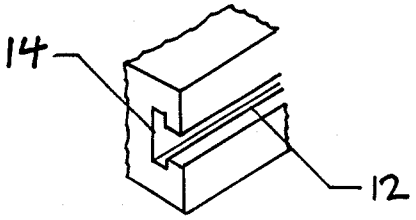
FIGS. 3A to 3E respectively show a fragmentary isometric view of the channel 12, the insertion position of the slider 2 into the channel 12, the plan and elevation views of a slider in the channel 12 in a center cubelet, and an isometric view of the channel network.
Figure 4:
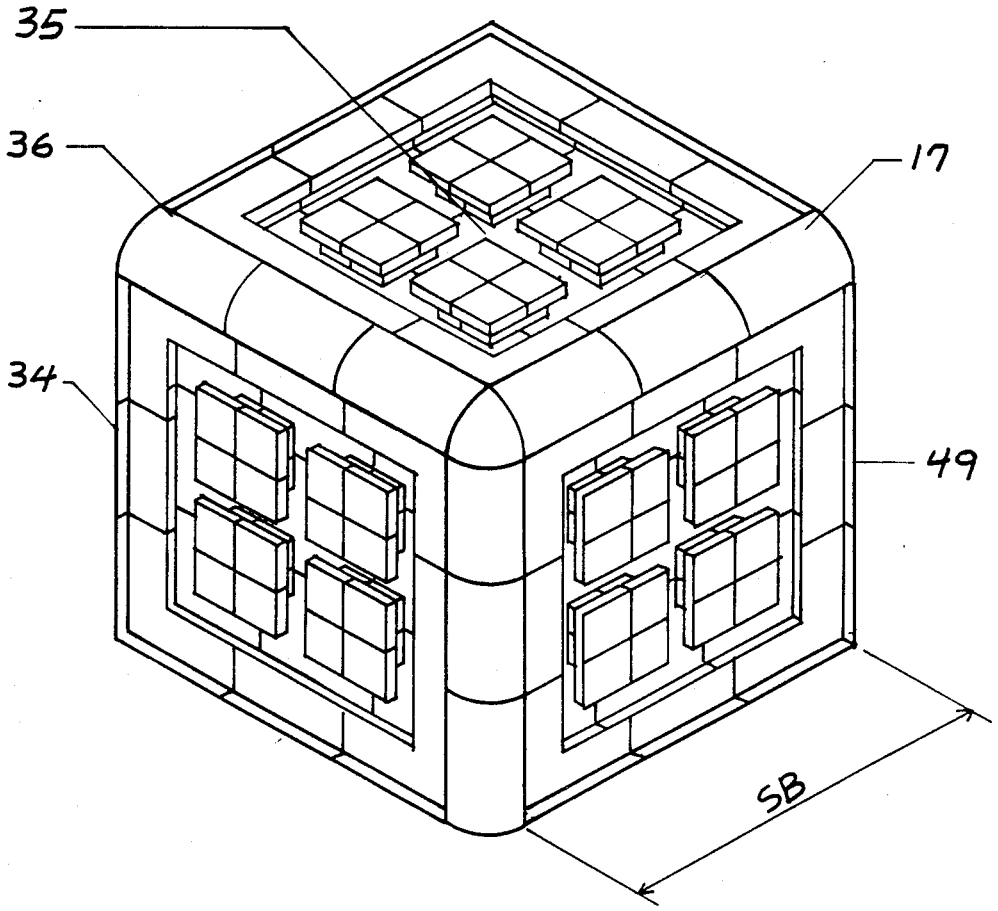
FIG. 4 shows an isometric view of the base cube 49.

FIG. 3A shows a fragmentary view of the channel 12. In the cube puzzle, there are six center cubelets 35, twelve edge cubelets 34 and eight corner cubelets 36, as shown in FIG. 4. These cubelets are individually shown in FIGS. 6A, 8A and 10A. A groove or slot 14 (FIG. 3A) with a cross-section in the shape of an inverted T runs along the length of the face of each cubelet 34, 35 and 36. The T-shaped groove/slot 14 thus forms a channel on each of the cubelets, which thus are continued via adjoining cubelets to extend across the face of each cube. The groove 14 is shown in FIG. 3A and the cubelets 34, 35 and 36 are shown in FIG. 4. FIGS. 6A to 6D, 8A, 10A and 10B show details of these cubelets.

Figure 3B:
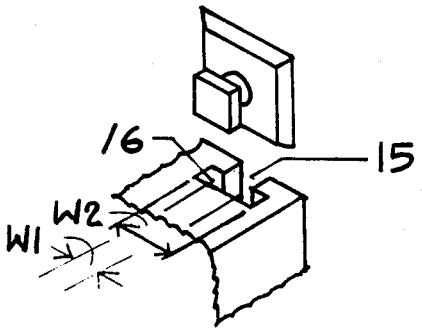
Figure 3C:
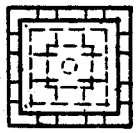
Figure 3D:
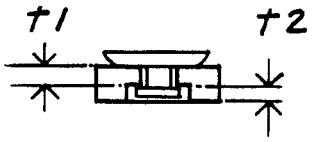

The channel 12 thus formed by the T-shaped groove 14 is ultimately the path for the slider 2 of FIG. 2C. There are two rectangular openings 15,16 (FIG. 3B) forming the T-shaped groove/slot 14. The slider 2 is held as shown in FIG. 3B, and is placed into the channel 12 in such a manner that the parallelopiped 3 of the slider moves on the channel surface. The smaller end of the connecting rod 8 fits into hole 15 of the channel and part 10 of the slider. FIGS. 3C and 3D respectively show plan and elevation views of the slider 2 completely slid into position in the channel 12. The length a (FIG. 2C) of the side of square 10 of the slider 2 is made bigger than the width W1 of hole 15 (FIG. 3B) of the channel 12, and hence the slider cannot be removed perpendicularly off the channel once it is slid into it. The width W2 of the hole 16 (FIG. 3B) of the channel is greater than the length a of the side of the square 10 of the slider 2, so that the square 10 can easily fit into hole 16 when the slider 2 is slid into the channel 12. The distance DU of the connecting rod 8 (FIG. 2B) is made slightly smaller than the thickness t1 of hole 15, so that when the slider 2 is slid into the channel, the spring 7 of the slider 2 gets compressed by an amount t1 minus DU. Since the spring 7 gets compressed, sufficient frictional force is developed between the channel 12 and slider 2. The spring constant of the spring 7 is chosen so that the frictional force developed is small enough to permit the slider 2 to slide into the channel 12 when manually slid, but is large enough to prevent the slider from moving in the channel due to its own weight. The parallelopiped box 3 is chamfered as shown by the cross-sectional view of FIG. 2B and FIG. 2C, so that the slider 2 can slowly slide into the channel 12, thereby increasing the exposed length DV of the connecting rod 8 slowly from the original length DU to the thickness t1 of hole 15. The thickness t2 of hole 16 is greater than the thickness ts of square 10 of the slider 2, so that there is enough clearance between the bottom surface of square 10 and the channel 12. As illustrated in FIG. 2B, the parallelopiped box 3 and square 10 of the slider 2 are chamfered. This helps the slider 2 to enter a channel 12 (FIG. 3A) smoothly. Also, the corners of the sliders may be rounded.

Figure 3E:
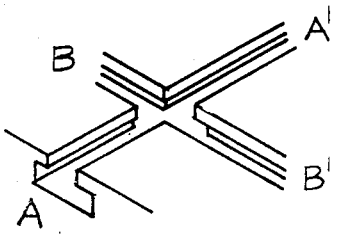

Two channels 12 (FIG. 3A) can intersect each other at right angles as shown in FIG. 3E. The network of channels formed by two or more channels, placed adjacent to each other and/or intersecting one another, provides the channel network 23. In the channel network 23 of FIG. 3E, the slider 2 entering at A and sliding along A–A′ can change direction at the point of intersection of A–A′ and B–B′, to move in the direction B–B′. Thus it can further slide either in the same direction or in a direction right-angled thereto if the channel network 23 permits. This is because the slider is symmetrical about the longitudinal axis passing through the center of the connecting rod 8. Thus the slider 2 can slide in two mutually perpendicular directions if the channel network 23 so permits. Rotation of a slider 2 at a point of intersection of two channels on one cubelet can be prevented by the face or cap 11 of the slider 2 being large enough to abut or be close to each adjoining cap 11, etc.

FIG. 4 shows an isometric view of the base cube 49, having six identical faces with rounded edges or bands 17. On each face there is a channel network 23 (made up of channels as in FIG. 3E) to permit the slider to slide in two perpendicular directions.

Figure 5:
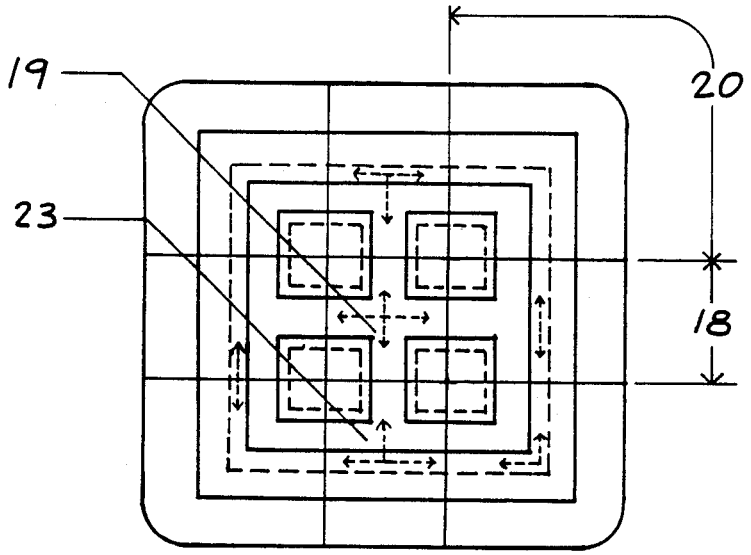
FIG. 5 shows the elevation plan of the channel network 23 of the base cube 49.

FIG. 5 shows a plan/elevation view of the channel network 23 of the base cube 49. The dotted arrows show the path a slider can take. Each face of the base cube 49 is further demarked into nine squares. Each of these squares is called a facelet, which are of three types as shown in FIG. 5. Thus, on each face of the base cube 49 there are four corner facelets 20, four edge facelets 18 and a center facelet 19. The part of the channel network 23 of a face contained by a facelet may be referred to as the mini-channel network 21 of the facelet, as in FIG. 1. The entire channel network 23 of the base cube 49 is formed because the mini-channel networks 21 of the individual facelets 18, 19 and 20 match when the facelets are arranged as on the face of the base cube 49. The size of the facelets 18, 19 and 20 is made just equal to or slightly more than the size of the face 50 (FIG. 2A) of the slider 2. Hence the nine sliders can be fitted (one on each facelet) on one face of the base cube. Thus for six faces a total of 54 sliders are required to cover the entire channel. However, in the present invention, as shown in FIG. 1, not all 54 sliders 2 are fitted on the facelets of the base cube, namely one or more facelets is exposed. An exposed facelet x (FIG. 1) can be regarded simply as a blank for purposes of a game. Thus a blank x is nothing but a facelet on which there is no slider. Any slider which is on a facelet adjacent to the blank x (and on the same face of the cube) can be slid as indicated in FIG. 1 along the mini-channel network 21 of the blank x, and can thus occupy that facelet. (Two sliders adjacent a blank x in FIG. 1 can move into the blank x.) The adjacent facelet from which the slider slides into the blank x now becomes a blank x, which can be similarly moved to different facelets on the face of the cube. By a rotatory move, the blank or any slider can be moved to another face of the base cube.

The base cube 49 is not just a solid cube with the channel network 23. It can be further disassembled into cubelets as shown in FIG. 4.

Figure 6A:
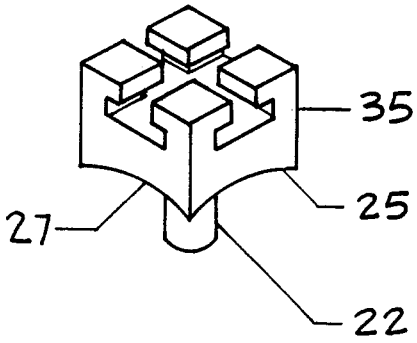
FIG. 6A shows an isometric view of the center cubelet 35 with its facelet facing up.
Figure 6B:
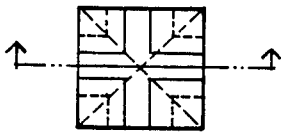
FIGS. 6B and 6C respectively show a plan view and a sectional elevation of the center cubelet 35.
Figure 6C:
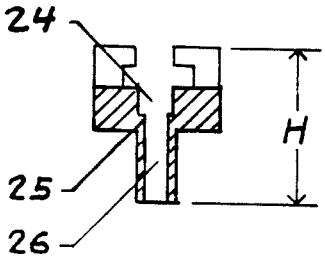
Figure 6D:
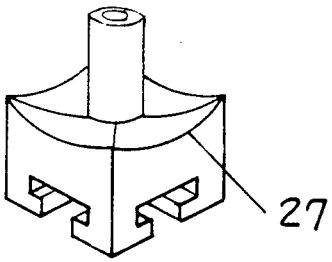
FIG. 6D shows an isometric view of the center cubelet 35 with facelet facing down.

FIGS. 6A and 6D show different views of the center cubelet. The hollow cylindrical shaft 22 goes perpendicularly though the cubelet as shown in FIG. 6A. There is a hole 24 in the hollow shaft 22 as shown in the sectional elevation of FIG. 6C. The interface 25 is the plane where the shaft hole becomes narrow. The bottom edges 27 of the center cubelet 35 are curved cylindrically on their interior as in FIGS. 6A and 6D to define nicks 27. All four nicks have the same radii of curvature defined as the radius of curvature of the base cube.

Figure 7A:
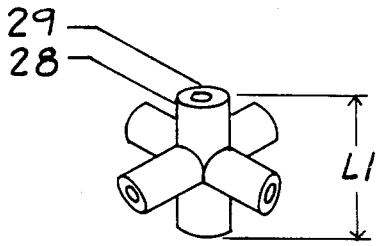
FIG. 7A shows an isometric view of the triaxis 29 of the spindle 33.

FIG. 7A shows an isometric view of the triaxis 29, with three axes in three perpendicular directions. Each axis of the triaxis 29 is a cylinder 28 of length L1 (FIG. 7A). The length L1 plus twice the height H of the center cubelet (FIG. 7B) together equal the length of one side SB (FIG. 4) of the base cube 49. There are internal threadings at the ends of each of the cylinders 28 of the triaxis 29 so that the six center cubelets 35 can be attached to the six cylindrical ends of the triaxis 29 by means of bolts.

Figure 7B:
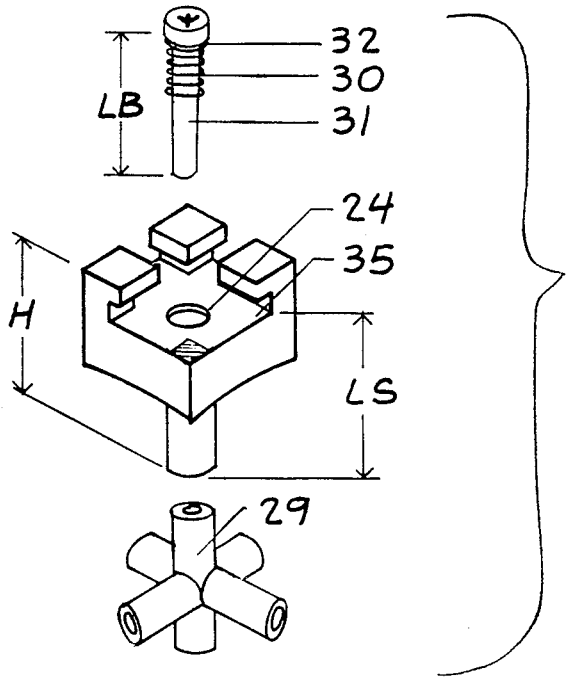
FIG. 7B shows a blown-up view of how the center cubelet 35 is attached to a cylinder of the triaxis 29 using a spiral spring 30, washer 32 and bolt 31.
Figure 7C:
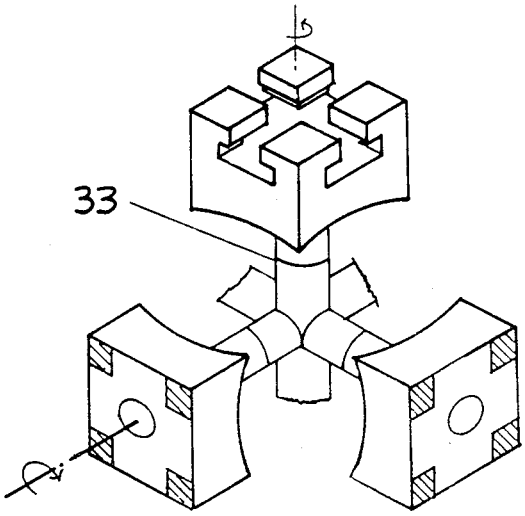
FIG. 7C shows a partial isometric view of the spindle 33.

FIG. 7B shows this method of assembly for any one center cubelet 35. A spring 30 is inserted into the shaft hole 24 of the center cubelet 35. The external diameter of the spring 30 is smaller than the internal diameter of the shaft hole 24, but is greater than the internal diameter of the shaft hole 26. Thus, when the spring 30 is inserted, it fits inside the shaft hole 24 without slipping into the shaft hole 26. (Shaft holes 24 and 26 are also shown in FIG. 6B). Then a bolt 31 (with a washer 32) of external diameter less that the internal diameter of the spiral spring 30 is inserted (FIG. 7B). The external diameter of the washer 32 should be greater than the internal diameter of the hole 24 of the shaft 22. The length LB of the bolt 31 is greater than the length LS of the shaft 22 by an amount such that the bolt 31, along with the spiral spring 30 and center cubelet 35, can be screwed into the internal threadings of the cylinder 28 of the triaxis 29. The length of the spiral spring 30 is big enough to be compressed when the bolt 31 is inserted into the hollow cylindrical shaft 22. Fit 7C shows the center cubelets attached to the triaxis in the manner described. The system of six center cubelets and the triaxis is called a spindle 33. FIG. 7C shows a partial isometric view of the spindle. Any center cubelet in the spindle 33 can be rotated about its own axis as shown by the arrows in FIG. 7C. This rotary motion of each of the center cubelets 35 gives the base cube its triaxial rotations.

Figure 8A:
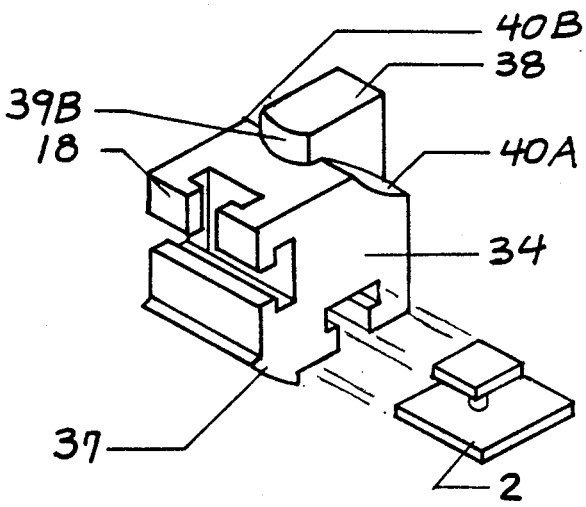
FIG. 8A shows an isometric view of the edge cubelet 34 and the route of a slider 2 into a minichannel network 21 of an edge cubelet 34.
Figure 8B:
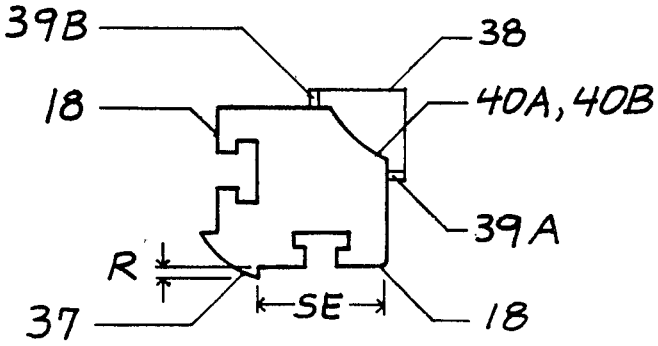
FIG. 8B shows the right-hand side view of an edge cubelet 34.

FIGS. 8A and 8B show details of the edge cubelet 34. The edge cubelet 34 contains channels on two of its faces. These two faces are called the edge facelets 18. One of the edge facelets 18 can be clearly seen in FIG. 8A. The other edge facelet is not completely visible (in FIG. 8A) since it is the bottom facelet therein. However, it is exactly identical to the other edge facelet which can be clearly seen. The two edge facelets 18 can be clearly seen in FIG. 8B. The size of a side of the edge facelet is denoted by SE as shown in FIG. 8B. The channel network of the edge facelets 18 permits the slider 2 to move into the channel and take a right-angled turn, or to go straight ahead in one direction, depending of the point of entry during the sliding of the slider. The common edge 37 of the two facelets 18 of the edge cubelet projects a distance R from the facelets as shown in FIG. 8B, and is rounded. This distance R above the plane of the facelet is equal to or slightly less than the thickness T3 of the slider (FIGS. 2B and 2C), so that when the slider slides into the facelet 18 of the edge cubelet, an effectively smooth surface across the top of the slider and the surface of the band is felt. As shown in FIGS. 8A and 8B, the edge cubelet has a foot 38 projecting outwards. The foot 38 has two cylindrical arcs 39A and 39B. Arc 39B can be clearly seen in FIG. 8A. Arc 39A is hidden in the isometric view of FIG. 8A. However, it is exactly like arc 39B and both arcs 39A and 39B are marked in the side view of FIG. 8B. The radius of the arcs 39A and 38B is the same as the radius of the base cube. The edge cubelet 34 also has two nicks 40A and 40B. The radii of the cylindrical nicks 40A and 40B are equal to the radius of the base cube. The edge cubelet is symmetric about the common plane perpenciclar to and bisecting the planes of the facelets forming it.

Figure 9A:
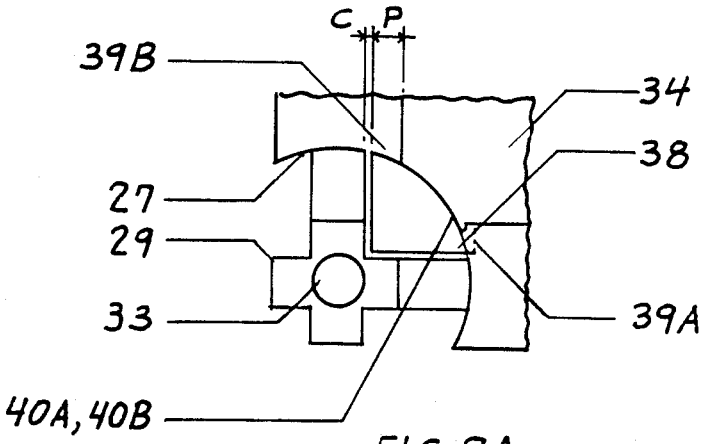
FIG. 9A shows an edge cubelet 34 trapped in between two center cubelets 35.

During assembly, two sliders 2 can be slid into the respective two facelets 18 of the edge cubelet (FIG. 8A). FIG. 9A shows the orthographic projection of the edge cubelet 34 fitted into the spindle 33. The foot 38 of the edge cubelet projects a distance P (FIG. 9A) into the nick 27 of the adjoining center cubelet 35. The distance P is provided so that a slight clearance C (FIG. 9A) is provided between the foot and the triaxis. Thus the edge cubelet is held in between two center cubelets.

There is no way by which the edge cubelet can be pulled out of this position. It however rotates with the adjacent center cubelet when the center cubelet is rotated about its axis. As can be seen in FIG. 9A, the centers of the area forming the nicks 27 and 40A and 40B of the center cubelet and the edge cubelets respectively, lie on the center line of the respective cylinders of the triaxis.

Figure 10A:
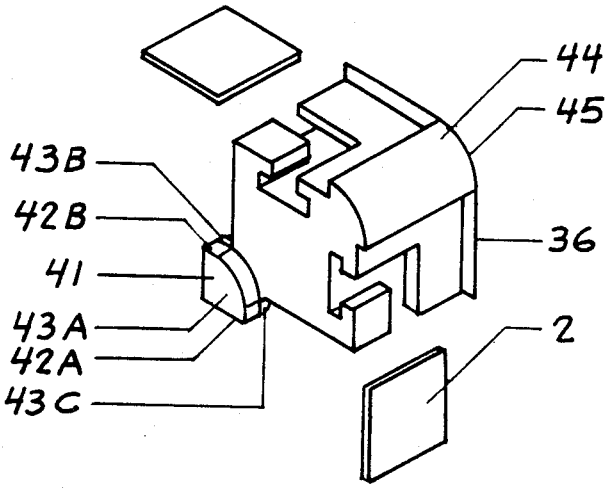
FIG. 10A shows one of the corner cubelets 36 with its toe 41 oriented down.
Figure 10B:
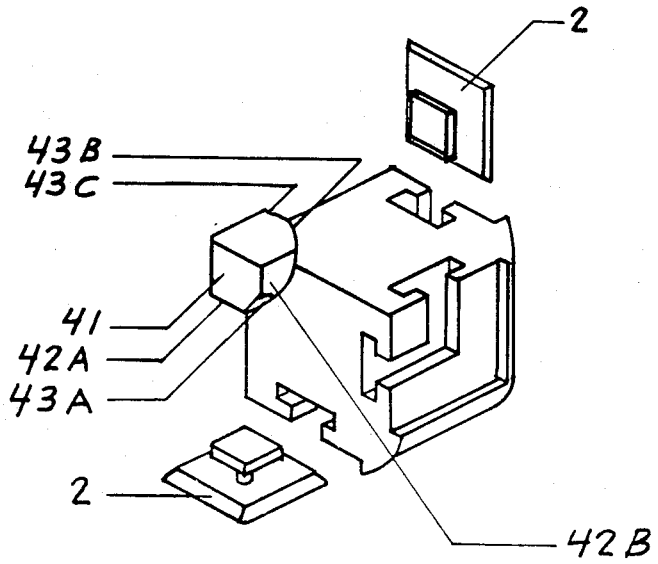
FIG. 10B shows one of the corner cubelets 36 with its toe 41 oriented up.

The corner cubelet 36 illustrated in FIGS. 10A and 10B contains three corner facelets 20 which are adjacent to each other and are in three perpendicular planes. One of the facelets 20 is hidden in FIG. 10A. The three facelets forming the faces of the corner cubelet have channels in them. This channel network permits the slider to take a right-angle turn. As in the edge cubelet 34 (FIG. 8A) and in the corner cubelet 36 (FIG. 10A), the common edges 44 between any two facelets are raised and rounded.

The edge cubelet 34 has a foot 38 projectiong outwards as shown in FIGS. 10A and 10B. The toe 41 has three identical cylindrical arcs 43A, 43B and 43C, in between the chamfered squares 42A, 42B and 42C. The radius of the cylindrical arcs 43A, 43B and 43C of the corner cubelet (FIG. 10A) is the same as the radius of the base cube, and each of the three arcs are centered on the center line of the respective cylinders of the triaxis.

The corner cubelet has a three-fold symmetry about an axis passing through the common corner 45 (the spherical corner wherein the three rounded edges 44 meet) and and which is equidistant from all the three corner facelets. This three-fold typer of symmetry permits the corner cubelets to take part in triaxial rotations.

During assembly, the sliders can be slid into the three facelets of each corner cubelet as shown in FIGS. 10A and 10B.

Figure 9C:
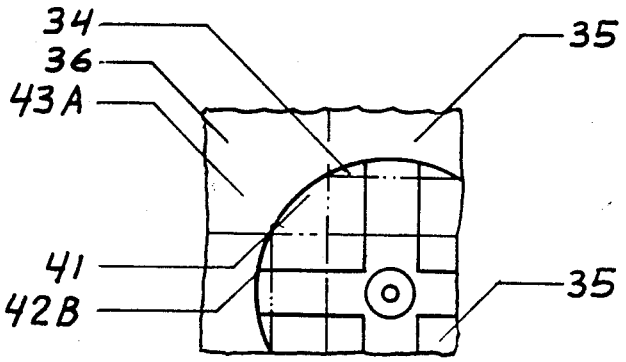
FIG. 9C shows the triaxis 29, three center cubelets 35, two edge cubelets 34 and one corner cubelet 36 holding each other.
Figure 9B:
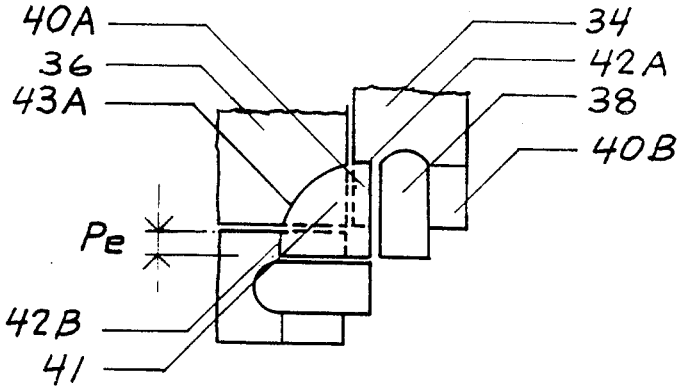
FIG. 9B shows one of the corner cubelets 36 trapped in between two edge cubelets 34.

FIG. 9B shows an orthographic projection of the corner cubelet 36 fitted in between two edge cubelets 34. The toe 41 of the corner cubelet 36 projects a distance Pe into the space between the nicks 40A or 40B, and this prevents the corner cubelet from being removed transversely. In other words, since toe 41 of the corner cubelet itself projects into the space between the nicks 40A or 40B of the edge cubelet (by distance Pe), the corner cubelet 36 cannot be removed laterally. The edge cubelets themselves are fixed as already illustrated in FIG. 9A. FIG. 9C shows how the corner cubelet 36 lies in the cavity formed by two edge cubelets 34, which are themselves fixed by three center cubelets 35.

The corner cubelets, like the edge cubelets, rotate when the center cubelet is rotated. This is because of the cylindrical arcs 43A/43B/43C of corner cubelet 36 which traces a circular path. Due to this three-fold symmetry, each corner cubelet can be rotated about any of three axes of the spindle 33.

Figure 11A:
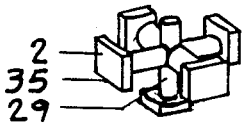
FIG. 11A shows an isometric view of the triaxis 29 fixed with five center cubelets 35 with sliders 2.

To assemble the cube puzzle, any five center cubelets 35 are attached to the triaxis 29 in the manner illustrated in FIG. 7B. Then the sliders are slid into the facelets 19 of the center cubelet. FIG. 11A illustrates this type of assembly.

Figure 11B:
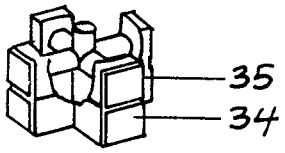
FIG. 11B shows an isometric view of the triaxis 29 fixed with five center cubelets 35 and edge cubelets 34, these cubelets having sliders 2.
Figure 11C:
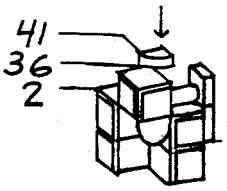
FIG. 11C shows an isometric view of the components in FIG. 11B, indicating a method of assembling the corner cubelets 36.
Figure 11D:
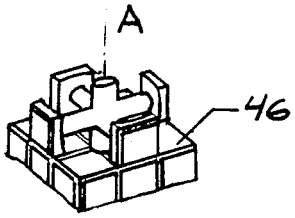
FIG. 11D shows an isometric view of the components in FIG. 11B assembled with four corner cubelets 36.

Sliders are also slid through the facelets of the remaining cubelets, except for at least one cubelet which is a blank. After this step is completed. As shown in FIG. 11A, the triaxis 29 is held in such a manner that the cylinder 28, without its center cubelet attached, is on top. Thereafter, four edge cubelets 34 are fitted between the bottom central cubelet 35 and the four adjacent central cubelets, as shown in FIG. 11B. As already illustrated in FIG. 9A, the foot 38 of the edge cubelet 34 protrudes into the space between the triaxis 29 and the nicks 27 of the central cubelet, thus preventing the edge cubelets from falling apart. After accomplishing this partial assembly, corner cubelet 37 (with toe 41 facing up as in FIG. 11C) is pushed (in the direction of the arrow as in FIG. 11C) between the two center cubelets into the region between the two edge cubelets, in such a manner that the toe 41 of the corner cubelet fits in the cavity between the nicks 40A, 40B of the adjoining edge cubelets. (The details of the corner cubelet trapped between the edge cubelets was indicated above in connection with FIGS. 9B and 9C.) Thus all the four corner cubelets 36 are fitted. This layer of four edge cubelets, four corner cubelets and one center cubelet (the center cubelet surrounded by the four edge and corner cubelets) forms the facial layer 46 of the cube (FIG. 11D). Holding the triaxis at rest, the facial layer 46 can be rotated (about the axis A–A' in FIG. 11D perpendicular to the face contained by the facial layer) as shown by the arrow in FIG. 11D. This rotation is possible because the cylindrical arcs 39A, 39B of the edge cubelet (FIG. 8A) and the cylindrical arcs 43A, 43B, 43C of the corner cubelet having the same radius (radius of the base cube) form a complete cylindrical surface which rotates inside the nicks 27 of the center cubelet above. Technically speaking, such a rotation of the cubelets in the cube is termed the rotatory motion of a facial layer.

Figure 11E:
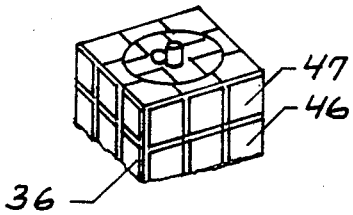
FIG. 11E shows an isometric view of the triaxis 29, with the facial layer 46 and equatorial layer 47 of the cube.

The next step in the assembly is the completion of the equatorial layer 47 as in FIG. 11E. The foot 38 of the edge cubelet 34 protrudes into the space between the triaxis 29 and the nicks 27 of the center cubelet. The four edge cubelets are thus assembled between the four center cubelets. This layer of the four edge cubelets and the four center cubelets is defined as the equatorial layer 47 (FIG. 11E). The assembly of the edge cubelets of the equatorial layer does not hinder the rotation of the facial layer below the equatorial layer. This is because the nicks 18, 40A/40B of the center and edge cubelets, respectively, just surround the cylindrical surface formed by the toes 41 and the feet 38 of the corner and edge cubelet of the facial layer.

Figure 11F:
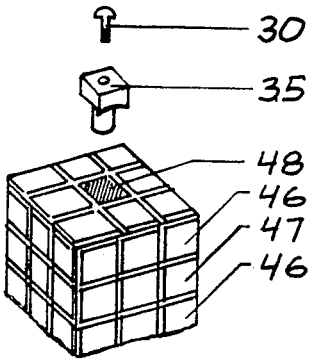
FIG. 11F shows an isometric view of the method of fixing the center cubelet 35 with spiral spring 30, washer 32 and bolt 31 to the rest of the cube puzzle already assembled.

The final step is the assembly of the top facial layer 46. The four edge cubelets and four corner cubelets (FIG. 11F) are placed over the cubelets of the equatorial layer 47. Now the top facial layer 46 is complete except for the remaining center cubelet 35. The spiral spring 30, the washer 32 and the bolt 31 are then inserted into the center cubelet (FIG. 7B). Since there are at most 53 sliders, the sixth center cubelet can be inserted without the slider. Then the center cubelet is inserted into the square gap 48 (FIG. 11F), and with a screw driver the bolt is tightened to the remaining cylindrical end of the triaxis 29. The assembly of the cube puzzle is now complete. Since all facial layers 46 have exactly the same internal structure as the bottom facial layer 46, and due to the symmetry elements of the cubelets, the facial layer 46 can be rotated about its axis.

Figure 12:
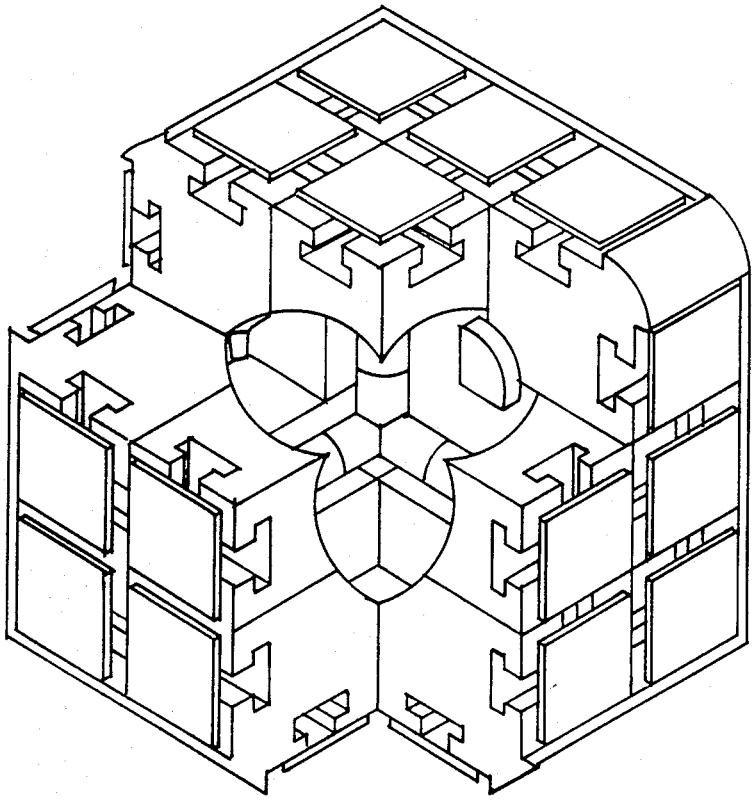
FIG. 12 shows an isometric view of the cube with a portion removed to show the internal mechanism of the cube.

FIG. 12 shows the internal structure of the cube puzzle, and is a comprehensive illustration of both the channel network which form the translatory mechanism, and the cylindrical mechanism which enables all the facial layers 46 to be rotated without falling apart.

Figure 13A:
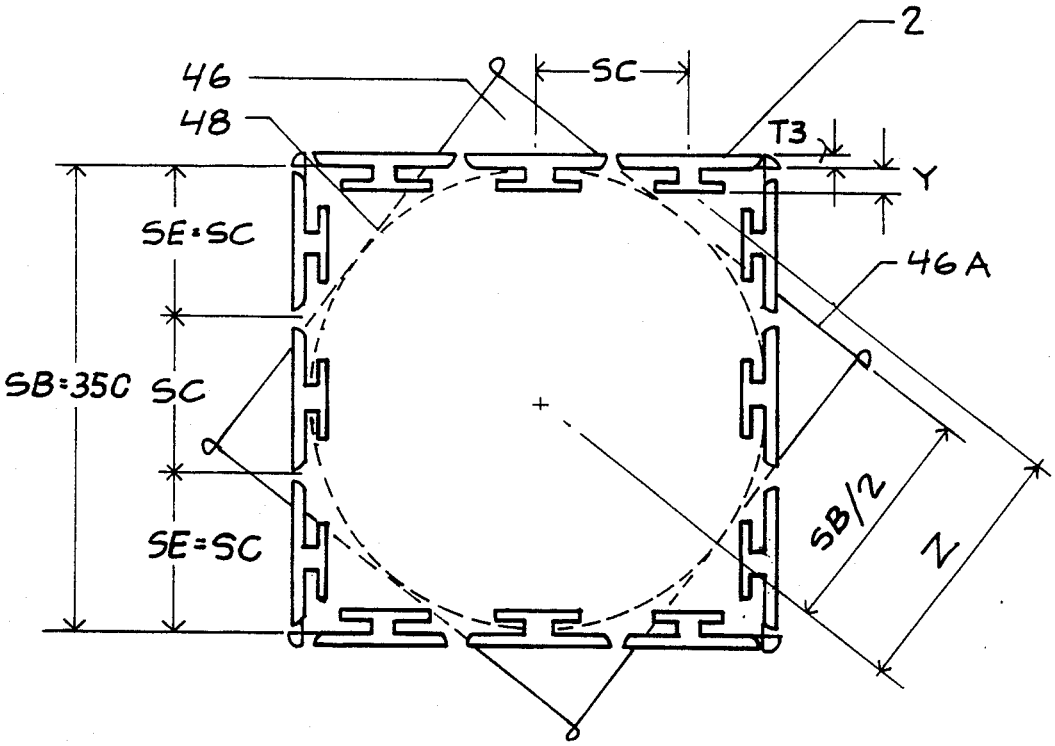
FIG. 13A shows a poorly designed sliding mechanism, wherein the slider can slide out of the channel of a cubelet when a layer of cubelets is rotated in a rotatory move of the puzzle cube.
Figure 13B:
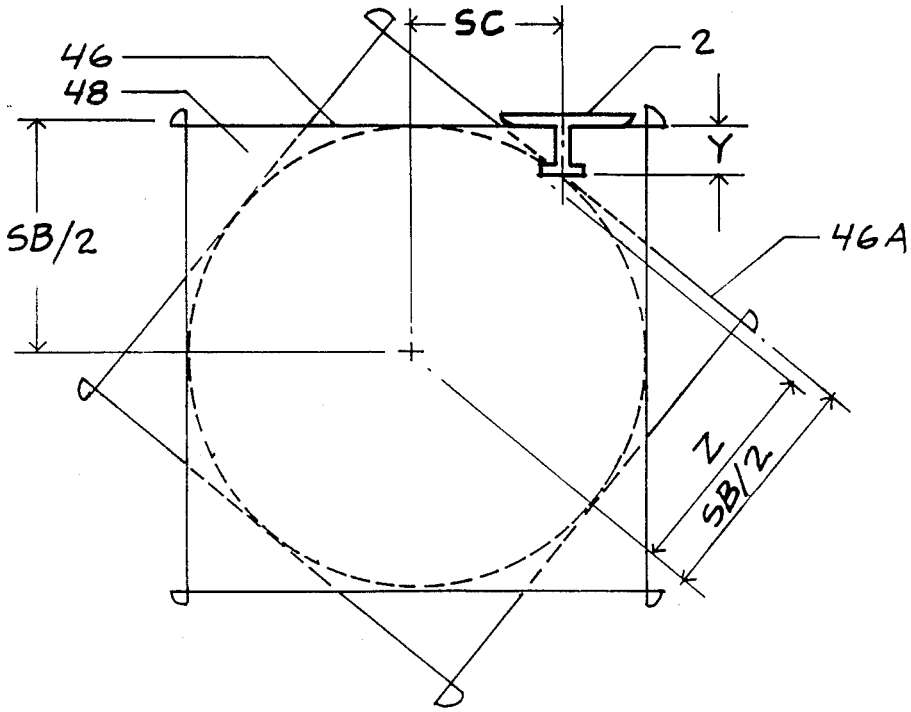
FIG. 13B shows a properly designed sliding mechanism for preventing such sliding out of a slider during a rotatory move.

One particular point to provide for during manufacture of the slider is that care must be taken to make sure that the dimensions of the sliders are chosen so that a slider sitting in say the middle facial layer or the equatorial layer 47 of the cube does not slide out of the mechanism when the top or bottom layers 46 are being rotated. FIG. 13A shows how this might happen for a poorly designed slider. In this figure, when the layer 46 is rotated, the edge 46A does not overlap anymore with the slider, and hence in this configuation the slider 2 can be slid out of the mechanism (into the page as in FIG. 13A, and hence out of the mechanism). This problem has been eliminated however for the slider as in FIG. 13B. There the dimension y of the slider is large enough so that the edge 46A of the facial layer 46 constrains the slider 2 from sliding out of the mechanism.

In FIG. 13A the distance z between the bottom of the slider and the center of rotation is greater then the perpendicular distance SB/2 of the edge 46A from the center of rotation. However, in FIG. 13B z is less than SB/2, and hence the slider 2 is constrained. Thus a rule of thumb to prevent the problem is that $z<SB/2=3SC/2=3SE/2$, where $SE=SC$ are the dimensions of the facelets of the edge and center cubelets (FIG. 13A). From FIG. 13B and by the Pythagorean theorem, $z^2=(SB/2-y)^2+(SC)^2=(3SC/2-y)^2+(SC)^2$. Therefore, the condition $z^2<(3SC/2)^2$ leads to $(SB/2-y)^2+(SC)^2<(SB/2)^2$, or $y^2-3(SC)y+(SC)^2<0$. Thus the dimension y of the slider is given by the roots of the above inequality, in other words that $y>(3-5^{\frac{1}{2}})(SC)/2$. Thus if the dimension y is so chosen, the problem is overcome.

However, this is just one generic way to overcome the problem of preventing sliders from sliding off the face of the base cube while a layer of cubelets of the base cube is being rotated. Depending on the actual geometry of the sliders and other dimensions of an embodiment of the puzzle, other such constraints or combinations thereof may be easily calculated and used. For instance, one may even make the thicknesses T3 of the sliders large enough so that the thickness T3 of sliders in for instance the bottom facial layers constrain the sliders in the equatorial layer from being removed from the mechanism while any of the layers are being rotated. In fact, if ordinary sliders are used, and they are likely to slip from a particular facelet due to their own weight, this thickness T3 can be provided so as to constrain them.

Figure 14:
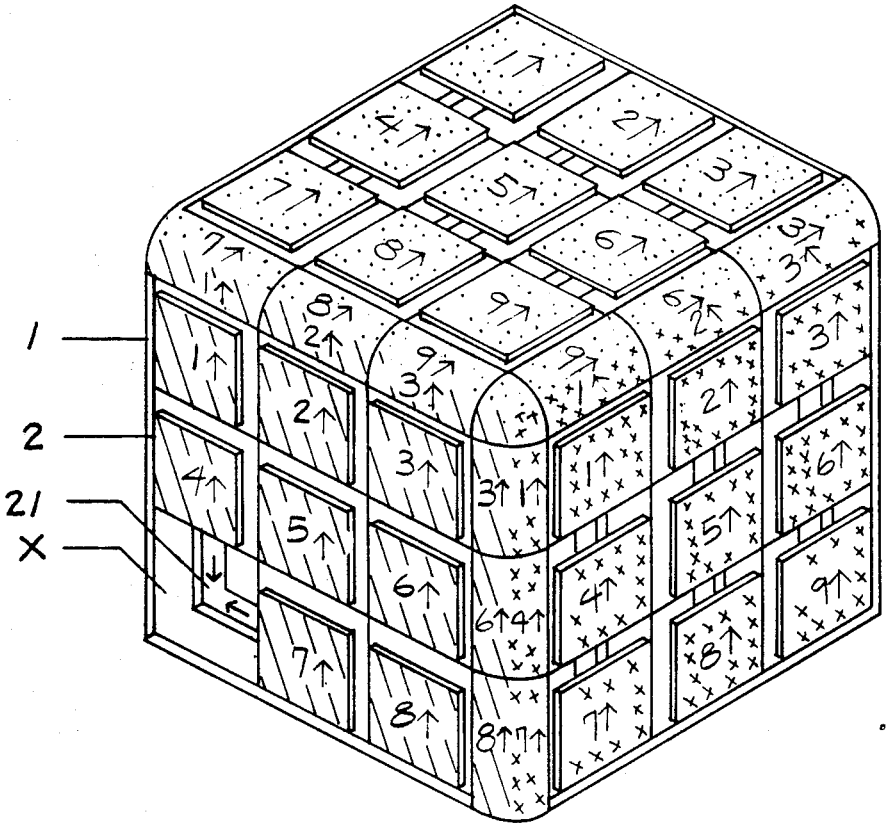
FIG. 14 shows an embodiment of a cube with respective parts labelled to play a game of a corresponding level of difficulty.

FIG. 14 shows one of the games that can be played with the assembled cube puzzle. Stickers can be stuck to the sliders such that initially sliders on the same face of the base cube have the same color, and different faces have different colors (or patterns). Also, numbers can be given to the sliders so that they are initially in a sequence on every face (FIG. 13). In addition, arrows can be provided to the sliders so that initially all arrows of the sliders on any particular face of the cube all point in the same direction. (FIG. 13). Corresponding to the colors, numbers and arrows of the sliders on a particular face, the bands of the base cube can also be provided with colors, numbers and arrows as shown in FIG. 13. The colors, numbers and arrows for the cubelets of the base cube not having bands (for example, the center cubelet 35) may be provided in their channels and can be made visible if the sliders sitting over them have a slightly smaller area than their facelets (FIG. 13), or through a small hole in each of the sliders, etc.

Thus, initially all sliders on any one face have the same color, have their numbers in order, and have all arrows pointing in the same direction. Also, each face is surrounded by bands such that the parts of a band near the sliders of one face have the same colors, numbers and arrows as the corresponding sliders. Also, cubelets not surrounded directly by bands can have appropriate colors, numbers, arrows, etc. on the visible parts of their facelets. This initial arrangement is shown in FIG. 14 by different patterns indicating different colors. Since the center slider on each of these faces does not have a corresponding band surrounding it, the exposed part of the channel of the center cubelet on which it rests is colored and arrows are provided on it (FIG. 14). On one of the facelets there is no slider, and hence it is a blank. From this position the cube can be jumbled by sliding sliders into the blank (by the above translatory move of a slider 2) and by rotating the layers (rotatory move). Thus, in general, both the sliders and the bands get jumbled. The aim of the game is to try and get back the initial position. This can be done by trying and matching the different sliders with the corresponding bands of the base cube (using the colors, numbers and arrows which have been provided), and by simultaneously trying to unscramble the bands themselves. Thus if a player managed to unscramble just the bands, the puzzle is not yet solved, since in general the sliders will not be in their proper places unless they have been matched with the corresponding bands. Also, while matching the sliders and the bands, the player should get not only the colors and numbers, but also the orientation of the sliders right. That is, the arrows on the sliders should point in the same direction as that on the corresponding bands. Otherwise it might happen that while the colors and numbers are properly matched, the arrows of all sliders on a face may not point in the same direction.

Thus in this puzzle there can be the challenge of matching the sliding parts (sliders 2) with the rotating parts (bands), while unscrambling the bands themselves. This whole idea, of having distinct sliding and rotating parts together in one mechanism, and the trying to match them and unscramble them, is entirely new and is not present in any existing cube puzzles, In fact, existing cube puzzles have only the rotating parts. By incorporating the channels and sliders in the rotating parts, an entirely new puzzle is provided which is based on matching sliding and rotating parts, rather than on merely unscrambling the rotating parts.

Since it is necessary to not only unscramble the bands but to also match the colors, numbers and arrows of the sliders appropriately, this game becomes much more complicated, interesting and different from the games hitherto possible in the existing cube puzzles.

Other simpler games can also be played of this mechanism, by dropping (that is, removing or disregarding) some or all of the numbers and/or arrows and/or colors of the sliders and/or bands. Thus, by merely changing the type of stickers stuck to the sliders and bands initially, one can have games of different complexity levels.

Yet another set of games can be played on the puzzle cube if one or more sliders are fixed initially to their respective facelets by means of for instance glue, tape or a small removable bolt. Thus, for example, the player might want to attach initially all the six sliders on the six center facelets of a $3\times3\times3$ cube to these facelets (sliders 5 in FIG. 14). The rest of the sliders are free as before. Now while the player is trying to solve the puzzle, the central slider cannot be slid to an adjoining blank, and thus sliders on a particular face can slide only around the central facelet, and never into it. In other words, each such fixed slider can never become a blank. Such games are challenging and give rise to another spectrum of difficulty within the scope of the puzzle.

Also, less complex games can be played by having more than one blank (that is, by having less than 53 sliders).

A variety of games can be devised, based on the number of blanks, different color combinations of the sliders and of the underlying parts of the base cube (such as the bands and/or facelets and/or channels). Thus many interesting games of different difficulty levels can be played, for instance by changing stickers on the sliders and base cube parts, and/or changing the number of blanks. Many such modifications of the puzzle within the present invention are available and obvious. The entire mechanism, which permits the sliders to slide without hindering the rotations of the various layers and vice versa, is new. The sliders can be designed so that they dont fall out when the layers are rotated or when the sliders are slid. Whereas simpler slides (without the spring, etc.) may be used, the slider described in detail above has the advantage that it can slide smoothly even if the faces of the cube are slightly misalligned. The feature of simultaneously arranging the colors, numbers and orientations of the sliders and the parts of the base cube (the bands and/or channel network may also be colored or numbered or given an orientation as by an arrow) involves a concept of matching parts (cubelets) moving in two dimensions with further parts (sliders) moving in three dimensions on each face of the base cube as well as rotating with the cubelets. It may be proper to speak of this in terms of the cubelets or bands having two degrees of freedom (at least two rotational degrees of freedom), if the rotations about the three axes in space effectively reduce to two degrees of freedom, for instance in correspondence to the two angular coordinates needed to specify each point on a sphere, while the sliders have more degrees of freedom (then two rotational degrees of freedom plus the translational degrees of freedom). These features of the present invention are applicable as well to base cubes having other than 3×3 cubelets per face, such as 2×2 cubelets per face, or 4×4 cubelets per face and higher.

While constructional details of the complete mechanism of a preferred embodiment has been described, the present invention is clearly applicable to the rotatable puzzle cubes of 2×2×2, 3×3×3, 4×4×4 and higher numbers of cubelets.

We claim:

1. A puzzle cube, comprising an array of cubelets extending in three dimensions to define a base cube with plural faces by respective facelets of said cubelet facelet wherein respective ones of said cubelets define respective sets of planes, the planes of any one of said sets of planes being orthogonal to the planes of each other one of said sets, each said facelet comprising a pair of orthogonal continuous channel segments defined by respective parts of the facelet which extend continuously from respective edges of each facelet to a central area of the facelet, the respective channel segments intersecting in a limited area at the center of each said facelet, said channel segments of all the respective facelets thereby defining a substantially continuous channel network for each said face of said base cube, internal support means for supporting said cubelets in the form of said base cube, and for allowing the respective cubelets associated with any one of said planes to be rotated as a unit about a respective axis perpendicular to the respective set of planes, sliders associated with at most all but one of said facelets of said cubelets of said base cube, said sliders having respective engaging parts on the backs thereof for being secured in said channels of the respective facelet and for holding the respective facelet from only its back in said channel segments so that the entire front of the slider is exposed to an operator and constrained to move substantially smoothly therein and for moving between adjacent facelets via said channel network, each said facelet not having one of said sliders associated therewith being exposed in the respective face of said base cube, wherein each occurrence of an exposed facelet can be effectively moved around the respective face of said base cube by sliding any one of the next respective sliders along any respective one of said channel segments of said channel network on the same face of the base cube, each said occurence of an exposed facelet can be effectively rotated onto a different one of said faces of said base cube by rotation of at least one respective one of said planes of one of said orthogonal sets thereof with respect to each other of said planes of the same set, and said cubelets with said channel segments of said channel networks, said sliders with said engaging parts, and the number of said sliders are provided so that each said slider is capable of non-rotational, linear motion along each of two directions in each said face, said two directions of linear motion across each said facelet being defined by respective ones of said channel segments.

2. The puzzle cube of claim 1, wherein each said slider has a square face for effectively covering the respective underlying facelet, and for preventing rotation during said motion along said channel segments.

3. The puzzle cube of claim 2, each said slider comprising a hollow parallelepiped box and a chamfered square plate connected together to move in each said channel by a bolt means including a spiral spring and washer, to provide a smooth sliding movement in said channel network.

4. The device of claim 2, said engaging parts and said channel segments having a sufficient depth into said cubelets so that when the cubelets of any one of said planes are rotated with respect to an adjoining parallel plane of adjoining cubelets, any of said sliders in channel segments of said cubelets of either one of the two adjoining planes is prevented from sliding off the face of the cube, as a result of movement all the way out along said channel segments of the respective cubelet toward at least one of the other of the two adjoining planes of cubelets being blocked by contact of at least said engaging part of the slider and at least one respective one of the cubelets of the other of the two adjoining planes.

5. The puzzle cube of claim 3, each said slider having a face parallel to and displaced from the respective face of the base cube in which the slider is located, each said slider being symmetric with respect to a 90 degree rotation about an axis perpendicular to said face of the slider.

6. The puzzle cube of claim 1, having a configuration of N by N by N of said cubelets, wherein N is an integer equal to or greater than 2.

7. The puzzle cube of claim 6, wherein said sliders with said engaging parts and said cubelets with said channel segments on their facelets are provided so that said sliders cannot slide out of the respective channel segments during each said rotation of said orthogonal planes.

8. The puzzle cube of claim 6, wherein N is at least 3.

9. The puzzle of claim 6, wherein N is 2, 3 or 4.

10. The puzzle cube of claim 1, said base cube comprising bands formed by respective parts of predetermined ones of said cubelets, respective ones of said bands extending around the periphery of each said face of said base cube, thus providing a frame around said sliders on each said face of said basic cube.

11. The puzzle cube of claim 10, wherein respective ones of said cubelet faces, bands and sliders are provided with a combination of patterns, to indicate at least one of the position and orientation of corresponding ones of said cubelet faces, bands and sliders, for providing games of respective complexity levels.

12. The device of claim 11, said patterns comprising at least one of arrows, colors and numbers.

13. The device of claim 12, said patterns comprising arrows.

14. The device of claim 12, said patterns comprising colors.

15. The device of claim 10, wherein said cubelets with said channel segments of said channel networks, said bands on said respective cubelets, said sliders with said engaging parts, and the number of said sliders are provided so that each said slider is effectively constrained to said non-rotational, linear motion along said two directions in each said face.

16. The puzzle cube of claim 1, said cubelets having effectively two degrees of rotational freedom, and said sliders thereon having effectively additional degrees of translational freedom.

17. The puzzle cube of claim 1, respective ones of said cubelets being provided with raised and rounded edges to define a frame around each said face of said basic cube.

18. The puzzle cube of claim 1, comprising fixing means for fixing at least one selected one of said sliders to at least one respective one of said cubelets, for playing a respective game with each said selected slider fixed to the respective facelet of the respective cubelet.

19. The puzzle cube of claim 11, comprising a respective one of said selected sliders being fixed on each said face of said base cube for playing said respective game.

20. The device of claim 1, said engaging parts and said channel segments having a sufficient depth into said cubelets so that when the cubelets of any one of said planes are rotated with respect to an adjoining parallel plane of adjoining cubelets, any of said sliders in said channel segments of said cubelets of either one of the two adjoining planes is prevented from sliding off the face of the cube, as a result of movement all the way out along each respective channel segment of the respective cubelet toward at least one of the other of the two adjoining planes of cubelets being blocked by contact of at least said engaging part of the slider and at least one respective one of the cubelets of the other of the two adjoining planes.

* * * * *

UNITED STATES PATENT AND TRADEMARK OFFICE

CERTIFICATE OF CORRECTION

PATENT NO. : 4,872,682

DATED : Oct. 10, 1989

INVENTOR(S) : Ravi Kuchimanchi, et al.

It is certified that error appears in the above-identified patent and that said Letters Patent is hereby corrected as shown below:

Column 11, line 52 (claim 1, line 4), should read as follows:
--facelets of said cubelet facelets, wherein respective--.

Signed and Sealed this

Twenty-fourth Day of December, 1991

*Attest:*

HARRY F. MANBECK, JR.

*Attesting Officer*

*Commissioner of Patents and Trademarks*